US005414926A

United States Patent [19]

Ito et al.

[11] Patent Number: 5,414,926

[45] Date of Patent: May 16, 1995

[54] TERMINAL CRIMPING APPARATUS

[75] Inventors: Akira Ito; Mamoru Takubo, both of Yokkaichi, Japan

[73] Assignee: Sumitomo Wiring Systems, Ltd., Japan

[21] Appl. No.: 132,356

[22] Filed: Oct. 6, 1993

[30] Foreign Application Priority Data

Oct. 9, 1992 [JP] Japan ..... 4-70658 U
Oct. 9, 1992 [JP] Japan ..... 4-272070

[51] Int. Cl.[6] ..... H01R 43/048

[52] U.S. Cl. ..... 29/753; 29/863; 72/412

[58] Field of Search ..... 29/33, 564.4, 566.2–566.4, 29/747, 748, 751, 753, 861, 862, 863; 72/402, 410, 412, 416, 441; 81/424.5, 426, 426.5

[56] References Cited

U.S. PATENT DOCUMENTS

| | | | |
|---|---|---|---|
| 2,982,329 | 5/1961 | Batcheller | 72/412 |
| 3,018,816 | 1/1962 | Cobough et al. | 72/412 |
| 4,587,725 | 5/1986 | Ogawa et al. | 29/753 |
| 4,890,384 | 1/1990 | Shaffer | 29/863 |
| 5,084,963 | 2/1992 | Murray et al. | 29/751 X |
| 5,277,050 | 1/1994 | DeRoss et al. | 29/753 X |

FOREIGN PATENT DOCUMENTS

| | | | |
|---|---|---|---|
| 52-24784 | 6/1977 | Japan | 29/753 |
| 55-37840 | 9/1980 | Japan | 29/753 |
| 2-257001 | 10/1990 | Japan | 29/753 |
| 3-165478 | 7/1991 | Japan | 29/863 |
| 3-291881 | 12/1991 | Japan | 29/753 |

*Primary Examiner*—Peter Dungba Vo
*Attorney, Agent, or Firm*—Beveridge, DeGrandi, Weilacher & Young

[57] ABSTRACT

The terminal crimping apparatus includes a pressure receiving part provided with a pressure receiving surface for receiving a terminal having a barrel of which tips are chamfered at outer peripheral sides thereof, and caulking part having a caulking surface adapted to receive the pressure receiving part, for caulking the barrel of the terminal between the caulking surface and the pressure receiving surface of the pressure receiving part such that one of tips of the barrel overlaps the other. The caulking part has two rounding surfaces and a step portion therebetween having one end located at the deepest point formed at a middle portion of the caulking surface. The step portion has a difference in level at least equal to the thickness of the tips of the barrel. The deepest point of the pressure receiving surface and the deepest point of the caulking surface are located on a virtual line parallel with a symmetrical line of the barrel.

13 Claims, 13 Drawing Sheets

TERMINAL CRIMPING APPARATUS

CROSS REFERENCE TO RELATED APPLICATION

This application claims priority benefits under 35 USC §119 of Japanese Utility Model Application Serial No. 4-70658 and Japanese Patent Application Serial No. 4-272070, filed, respectively, Oct. 9, 1992, the disclosure of which is incorporated by reference.

BACKGROUND OF THE INVENTION

1. Field of the Invention

The present invention relates to a terminal crimping apparatus and more particularly to a terminal crimping apparatus for crimping a terminal of an open barrel type to an end of an electric wire.

2. Description of the Related Art

As an example of a terminal to be crimped to an end of an electric wire, there is conventionally known a terminal of the opened barrel type. As shown in FIG. 1, such a terminal of the opened barrel type has a wire barrel 11 to be crimped to a conductor W1 at an end of an electric wire W, and an insulation barrel 12 to be crimped to a coated end W2 of the electric wire W. Each of the barrels 11, 12 has a substantially U-shaped section and is of linear symmetry. A terminal 1 (See FIG. 2) can be crimped to an end of the electric wire W in the following manner. With the conductor W1 and the coated end W2 of the electric wire W respectively introduced into the wire barrel 11 and the insulation barrel 12, the barrels 11, 12 are respectively caulked by two pairs of crimpers 13 and anvils 14 of a terminal crimping apparatus, each pair of crimper 13 and anvil 14 being vertically disposed with each of the barrels 11, 12 sandwiched therebetween. As a method of crimping a terminal 1, there is known a so-called overlap crimping method, as shown in FIG. 3, by which one tips 111, 121 of the barrels 11, 12 overlap the other tips 112, 122 of the barrels 11, 12 (Japanese Patent Unexamined Publication Serial No. 3-165478, Japanese Patent Unexamined Publication Serial No. 3-291881, Japanese Patent Examined Publication Serial No. 55-37840, and Japanese Utility Model Examined Publication Serial No. 52-24784).

To carry out the overlap crimping above-mentioned, each of the crimpers 13 has a caulking surface for pushing the barrel 11 or 12, and this caulking surface has a step portion **13*c*, a first round portion 13*a* and a second round portion 13*b*, the first and second round portions 13*a*, 13*b* smoothly integrate with each other through the step portion 13*c*, as shown in FIG. 2. The step portions 13*c* are formed at positions biased toward the second round portions 13*b* with respect to the center portions 13*d* of the caulking surfaces. On the other hand, each of the anvils 14 has a pressure receiving surface 14*a* for receiving the barrel 11 or 12. The pressure receiving surfaces 14*a* are arcuate as depressed downwardly with respect to the drawing plane of FIG. 2 such that the barrels 11, 12** are adapted to be received.

When the crimpers 13 and the anvils 14 press the barrels 11, 12 by pinching the barrels 11, 12 therebetween, tips 111, 121 of the barrels 11, 12 move along the corresponding first round portions **13*a* while the other tips 112, 122 move along the corresponding second round portions 13*b*, utilizing the step portions 13*c* at the boundaries between these round portions 13*a*, 13*b*, so it is possible to caulk the tips 111, 121 of the barrels 11, 12 as overlapping the outer peripheral sides of the other tips 112, 122**.

In the conventional overlap crimping mentioned above, the following is presumed. When the crimpers 13 and the anvils 14 press the barrels 11, 12 by pinching the barrels 11, 12 therebetween, the tips 111, 121 of the barrels 11, 12 are so deformed as to follow the corresponding first round portions **13*a* while the other tips 112, 122 are so deformed as to follow the corresponding second round portions 13*b* so that the tips 111, 121 ultimately overcome the step portions 13*c* and overlap the outer peripheral sides of the other tips 112, 122**.

Dependent on the shapes of the barrels 11, 12 or the shapes of the caulking surfaces of the crimpers 13, there are instances where the tips 111, 121 of the barrels 11, 12 do not overlap the other tips 112, 122 but abut thereon, as shown in FIG. 4. This disadvantageously generates burrs B on those portions of the barrels 11, 12 which correspond to gaps between the crimpers 13 and the anvils 14. The inventor of the present application has studied what might be the cause of such defective crimping, and found the following fact.

Referring to FIGS. 5A to 5D, the following will discuss the mechanism for crimping the barrels 11, 12 by the crimpers 13 and the anvils 14. When the crimpers 13 approaches the anvils 14, the tips 111, 121 and the other tips 112, 122 of the barrels 11, 12 abut on each other in the openings of the crimpers 13. The shapes of the caulking surfaces and the opening widths at the vicinity of the openings of the crimpers 13 are determined such that the tips 111, 121 and the other tips 112, 122 are so deformed as to face each other. Accordingly, the tips 111, 121 and the other tips 112, 122 abut on each other while contacting with the first round portions **13*a*. As the crimpers 13 approaches further near the anvils 14 as shown in FIG. 5B, the tips 111, 121 are so deformed as to follow the first round portions 13*a* and the other tips 112, 122 are so deformed as to follow the second round portions 13*b*. As shown in FIG. 5*c*, the further caulking process from the state shown in FIG. 5B normally causes the other tips 112, 122 to overlap the tips 111, 121 as the other tips 112, 122 are pressed downwardly by the step portions 13*c* when the tips 111, 121 and the other tips 112, 122 follow respectively the corresponding round portions 13*a*, 13*b* to a certain extent, so that the other tips 111, 121, as shown in FIG. 5D, ultimately overcome the step portion 13*c***, thus completing the crimping processing.

In view of the foregoing, the inventor has found that the cause of defective crimping resides in the fact that the caulking step has been advanced without release of the state that the tips 111, 121 abut on the other tips 112, 122 (FIG. 5A).

Accordingly, what is really needed is a terminal crimping apparatus that can prevent the tips of a barrel from abutting on each other, thus preventing a crimped terminal from being defectively crimped.

In crimping a terminal 1, it is required that the electrical connection between the conductor W1 of the electric wire W and the wire barrel 11 is perfectly assured and that there is provided a crimping strength substantially equal to the tensile strength of the electric wire W. Therefore, the crimping quality is conventionally checked by measuring the crimp height H of the crimped terminal 1 (e.g., Japanese Patent Unexamined Publication Serial No. 2-257001).

FIG. 6 is a perspective view of a measuring device 2 for measuring the crimp height H. The measuring device 2 comprises a frame 20, a dial gauge 21 supported by the frame 20, a block-like movable contact piece 22 disposed at the tip of a measuring head of the dial gauge 21, and a block-like stationary contact piece 23 disposed opposite to and under the movable contact piece 22. As shown in FIG. 7, a measuring surface 22*a* of the movable contact piece 22 and a measuring surface 23*a* of the stationary contact piece 23 are horizontal and parallel to each other.

The crimp height H is measured in the following manner. As maintained in a posture in a crimping step, the crimped portion X of the crimped terminal 1 is held by and between the measuring surfaces 22*a*, 23*a*, and the scale on the dial gauge 21 is then read.

To measure the accurate crimp height H, it is required that the crimped portion X of each of the barrels 11, 12 is clamped between the measuring surfaces 22*a*, 23*a* while maintaining each of the barrels 11, 12 in a caulked posture.

In the conventional overlap crimping, however, a line L, which connects a contact point S1 where the measuring surface 22*a* of the movable contact piece 22 comes in contact with the crimped portion X to a contact point S2 where the measuring surface 23*a* of the stationary contact piece 23 comes in contact with the crimped portion X is inclined at a predetermined angle $\theta$ with respect to the clamping direction of the crimped terminal 1 by the contact pieces 22, 23, or the perpendicular direction, as shown in FIG. 7. Accordingly, when the crimped portion X is clamped between the contact pieces 22, 23, a moment of rotation is inevitably applied to the crimped terminal 1, causing the crimped terminal 1 to be rotated around the electric wire W. This may disadvantageously produce a measuring error, thus failing to make an accurate judgment of whether the crimping is good or defective.

Accordingly, what is needed is a terminal crimping apparatus capable of accurately measuring the crimp height of the crimped terminal.

SUMMARY OF THE INVENTION

The present invention is directed to a terminal crimping apparatus that satisfies these needs.

According to an aspect of the present invention, the terminal crimping apparatus has a member having a novel caulking surface for caulking a barrel. The caulking surface has a step portion. The difference in level between the ends of the step portion are less than the thickness of each barrel tip of which outer peripheral side is chamfered. The step portion has one end located at the deepest point of the caulking surface. The deepest point is formed at the center of the caulking surface. When a barrel of a terminal is caulked, one tip of the barrel can be brought into collision with the step portion, and the other tip can be brought into collision with a vicinity of the step portion of the caulking surface. This prevents the one tip of the barrel from abutting on the other tip thereof, thus preventing the barrel from being crimped to an electric wire with the both tips of the barrel abutting on each other. When the crimping step further proceeds, the other tip of the barrel can be securely guided to the inner peripheral side of the one tip of the barrel, in that the barrel tips are chamfered. When the crimping step further proceeds, the other tip of the barrel can readily get over the step portion in that the other tip of the barrel is chamfered and that the difference in level is set based on the thickness of each of the barrel tips. Accordingly, the other tip of the barrel can securely overlap the one tip, thus securely preventing the occurrence of defective crimping.

In the terminal crimping apparatus according to another aspect of the present invention, a virtual line connecting the deepest point of a pressure receiving surface for receiving a barrel, to the deepest point of a caulking surface for caulking the barrel, is parallel with the axis of linear symmetry of the barrel. Accordingly, the crimped portion of a barrel is caulked such that the portions thereof along the axis of linear symmetry project most. Therefore, even though the crimped portion of the barrel is held by a measuring device while maintaining the barrel in a caulked posture, no moment of rotation is applied to the crimped portion of the barrel. This prevents the terminal from being unexpectedly rotated. Thus, the crimp height can be accurately measured. It is therefore possible to accurately judge whether the crimping is good or defective.

These and other features, objects and advantages of the present invention will be more fully apparent from the following detailed description set forth below when taken in conjunction with the accompanying drawings.

DESCRIPTION OF PREFERRED EMBODIMENTS

Figure 8:
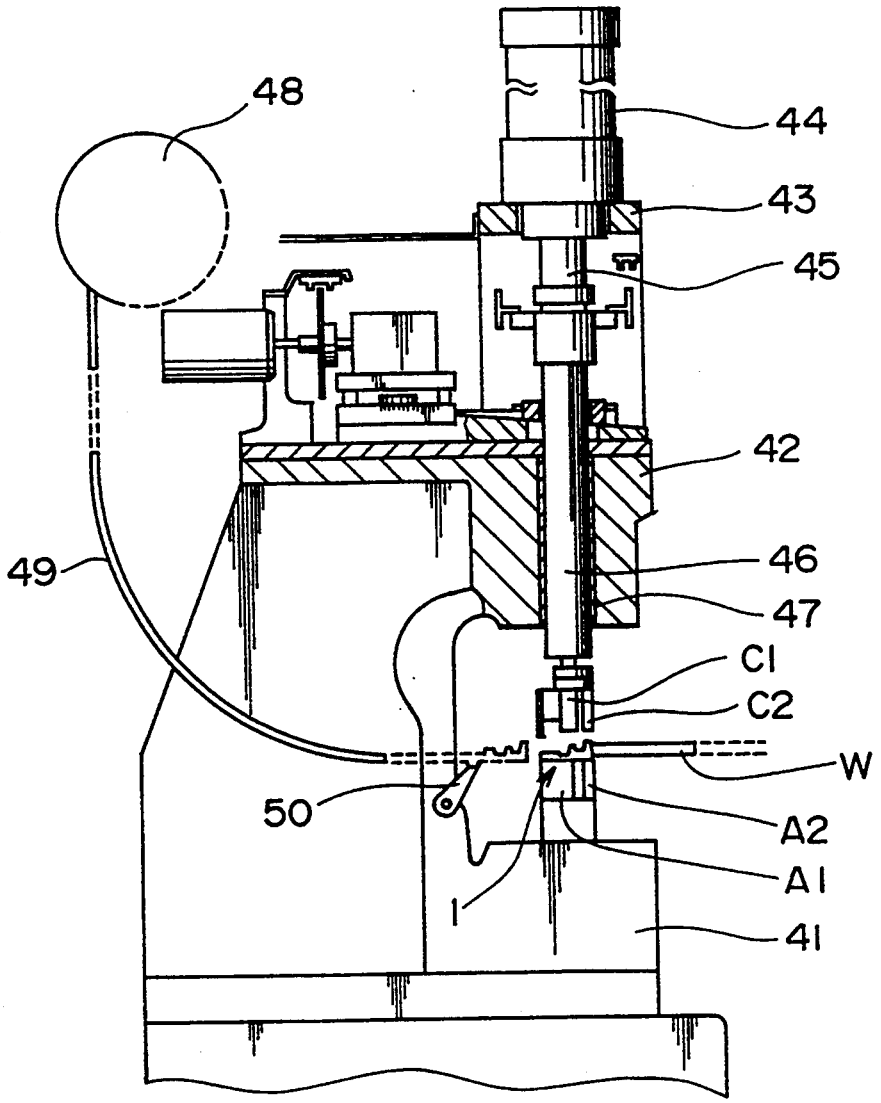
FIG. 8 is a side view of a terminal crimping apparatus according to an embodiment of the present invention.

Referring to FIG. 8, a terminal crimping apparatus according to a preferred embodiment of the present invention, has a frame 42 carried by a base 41. The frame 42 carries a column 43 which in turn mounts a hydraulic cylinder 44 directed downwardly. The hydraulic cylinder 44 has a rod 45 having a tip to which has a press ram 46 connected thereto. The press ram 46 is adapted to be moved up and down along the guide surface 47 on the frame 42. Crimpers C1, C2 are attached to the lower end of the press ram 46. Secured to the base 41 are anvils A1, A2 which are adapted to caulk a terminal 1 of the opened barrel type, in cooperation with the crimpers C1, C2. The crimper C1 and the anvil A1 are disposed for caulking a wire barrel 11 of the crimped terminal 1, and the crimper C2 and the anvil A2 are disposed for caulking an insulation barrel 12 of the terminal 1.

In this embodiment, the terminal crimping apparatus has a terminal chain reel 48. The terminal chain reel 48 holds terminals 1 as connected in the form of a chain or a belt. A terminal chain guide 49 is disposed between the terminal chain reel 48 and the anvils A1, A2. The chain-like terminals 1 held by the terminal chain reel 48 are delivered to the anvils A1, A2 through the terminal chain guide 49. A feed claw 50 is disposed at the downstream end of the terminal chain guide 49 for feeding, one by one, the terminals 1 as connected in the form of a chain, move toward the anvils A1, A2. With the wire barrel 11 and the insulation barrel 12 of a terminal 1 respectively mounted on the anvils A1, A2, the mechanism above-mentioned is operated to vertically move the crimpers C1, C2 to caulk the barrels 11, 12 so that the terminal 1 can be crimped to the conductor W1 and the coated end W2 of the electric wire W.

The terminal crimping apparatus mentioned above has excellent mechanisms including a mechanism for adjusting the crimp height of a terminal 1. Except for the arrangements of the crimpers C1, C2, the anvils A1, A2 and the like will be discussed later, the terminal crimping apparatus is arranged in the same manner as the apparatus disclosed in U.S. Pat. No. 4,587,725 by the applicant of the present application. Accordingly, a detail description of this apparatus is omitted here.

Figure 9:
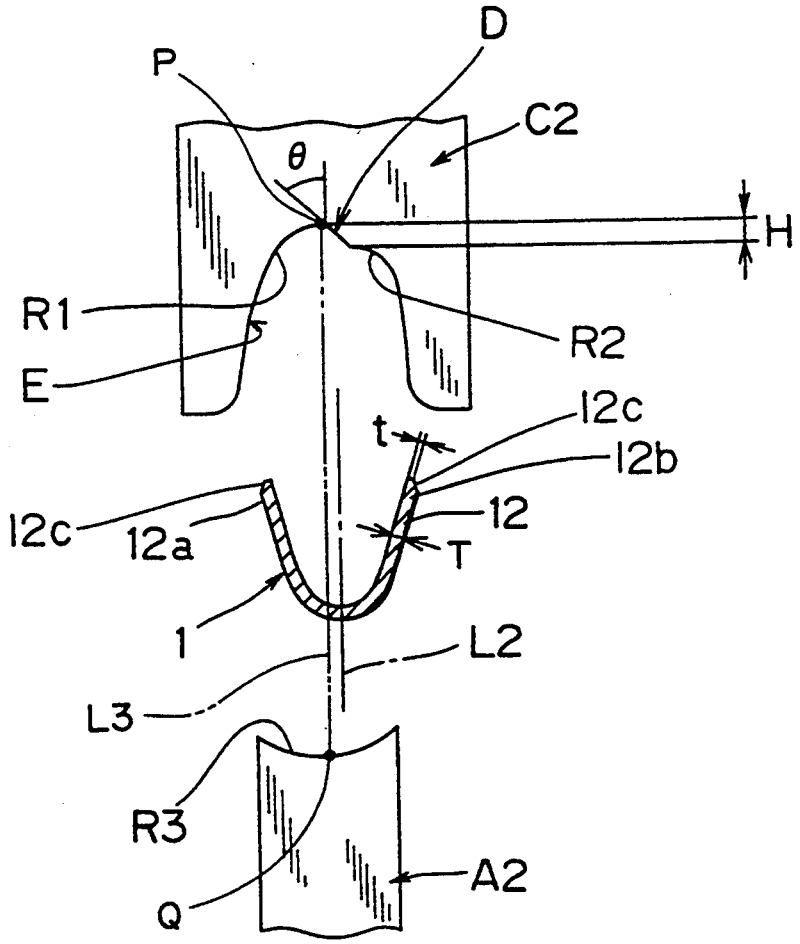
FIG. 9 is a schematic enlarged view of main portions of the terminal crimping apparatus in FIG. 8.
Figure 10:
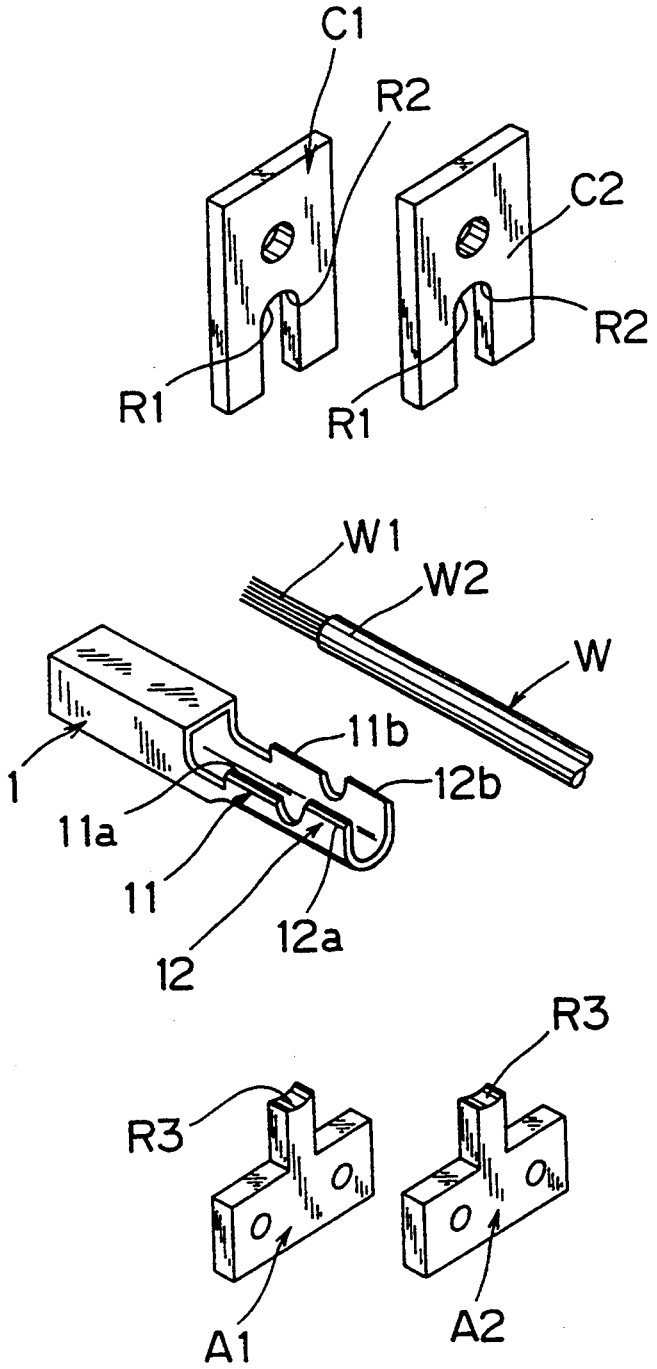
FIG. 10 is an exploded perspective view of main portions of the terminal crimping apparatus in FIG. 8.
Figure 11:
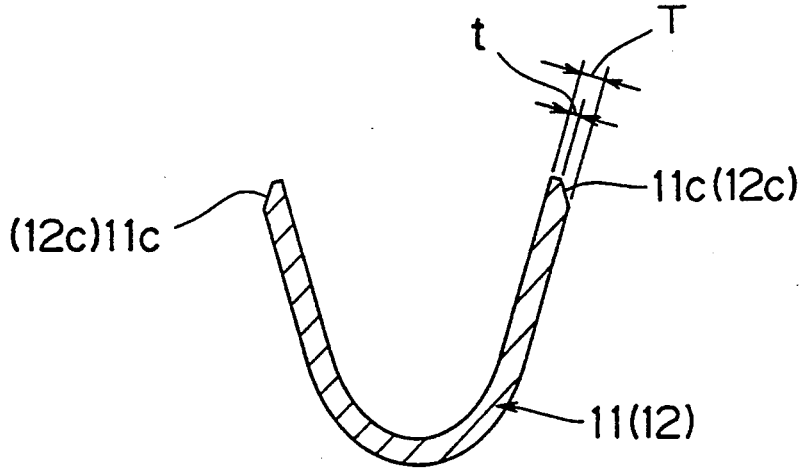
FIG. 11 is an enlarged section view of main portions of a terminal which can be applied to the present invention.

Referring to FIGS. 10 and 11, the barrel 11 of the terminal 1 has a pair of barrel claws 11*a*, 11*b* and the barrel 12 of the terminal 1 has a pair of barrel claws 12*a*, 12*b*. Each of the barrels 11, 12 has a substantially U-shaped section. Each of one barrel claws 11*a*, 12*a* and each of the other barrel claws 11*b*, 12*b* are substantially symmetric in their cross sections with respect to an axis of linear symmetry L2 which extends in the perpendicular direction (See FIG. 9). Each of the barrel claws 11*a*, 11*b* is provided on the outer peripheral side of the tip thereof with a chamfered surface 11*c*, and each of the barrel claws 12*a*, 12*b* is provided on the outer peripheral side of the tip thereof with a chamfered surface 12*c* (See FIG. 11). The sizes of each of the chamfered surfaces 11*c*, 12*c* are set such that the tip thickness t of each of the barrels 11, 12 is equal to, for example, about a half of the entire thickness T of each of the barrels 11, 12.

Referring to FIG. 9, the crimper C2 has a caulking surface E for pushing the insulation barrel 12, and the caulking surface E has a step portion D and at least two round portions R1, R2 which integrating with each other through the step portion D. On the other hand, a pressure receiving surface R3 of the anvil A2 opposite to the two round portions R1, R2, has a concave tip as shown in the drawing plane of FIG. 9 such that the barrel 12 is adapted to be received.

The step portion D of the crimper C2 is formed substantially at the center of the caulking surface E, i.e., on an extension line of the axis of linear symmetry L2 of the insulation barrel 12. Further, the step portion D is inclined at a predetermined angle $\theta$ (e.g., 45°) with respect to the perpendicular direction. The step portion D has one end which is located at the deepest point (apex) P formed at the center of the caulking surface E. The difference in level H between the ends of the step portion D is in the range from 1t to 1.5t where t refers to the tip thickness of the insulation barrel 12.

Further, provision is made such that a line L3 connecting the deepest point (apex) P of the caulking surface E of the crimper C2 to the deepest point (bottom) Q of the pressure receiving surface R3 of the anvil A2, is perpendicular, i.e., parallel with the axis of linear symmetry L2 of the insulation barrel 12.

Likewise in the prior art, the shape of the caulking surface E and opening width at the vicinity of the opening of the crimper C2 are determined such that the tips 11*a*, 12*a* and the other tip 11*b*, 12*b* are so deformed as to face each other.

The crimper C1 and the anvil A1 for caulking the wire barrel 11 have arrangements which correspond to the sizes of the conductor W1 of the electric wire W and which are respectively similar to those of the crimper C2 and the anvil A2 for caulking the insulation barrel 12.

According to the arrangement above-mentioned, when the terminal 1 is previously fed to the anvils A1, A2 from the terminal chain reel 48 shown in FIG. 8 and the cylinder 44 is operated to lower the press ram 46 from a raised position, the crimpers C1, C2 attached to the lower end of the press ram 46 respectively push the barrels 11, 12 of the terminal 1 so that the barrels 11, 12 are clamped between the crimpers C1, C2 and the anvils A1, A2.

Figure 12A:
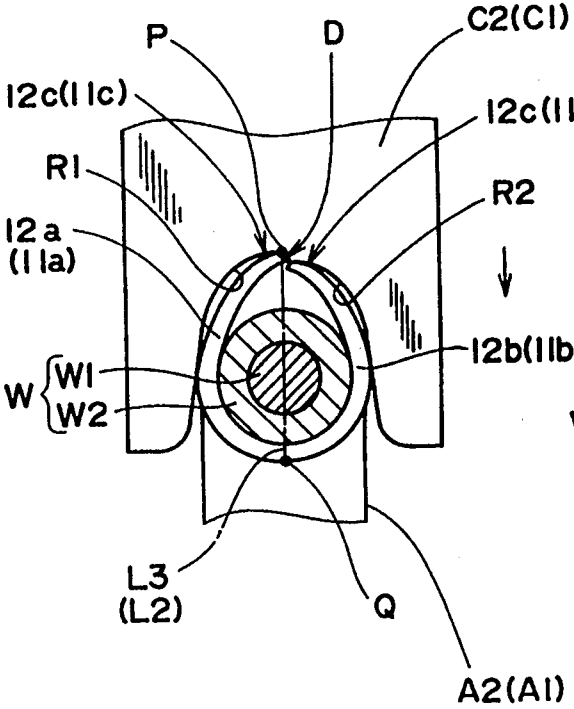
FIG. 12A to FIG. 12C are schematic enlarged views of a terminal illustrating a crimping mechanism with the passage of time.

When tips 11*a*, 12*a* and the other tips 11*b*, 12*b* of the barrels 11, 12 close to each other in the openings of the crimpers C1, C2 as shown in FIG. 12A, the tips 11*c*, 12*c* of one barrel claws 11*a*, 12*a* of the barrels 11, 12 come into collision with the step portions D of the crimpers C1, C2. The tips 11*c*, 12*c* of the other barrel claws 11*b*, 12*b* come into collision in the vicinity of the step portion D. In this embodiment, the differences in level H between the ends of the respective step portions D are set to values not less than the thicknesses t of the tips 11*c*, 12*c* of the barrels 11, 12. Accordingly, there is no likelihood that the tips 11*c*, 12*c* of the barrel claws 11*a*, 12*a* project toward the round portions R1 from the other round portions R2.

Figure 12B:
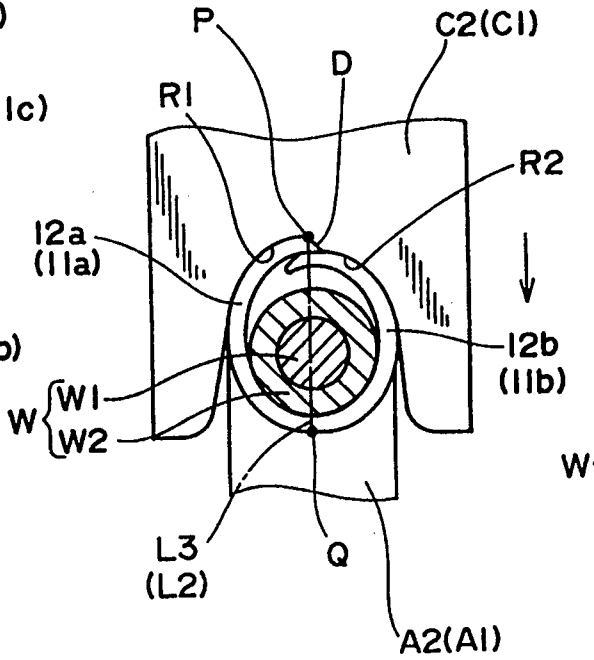
Figure 12C:
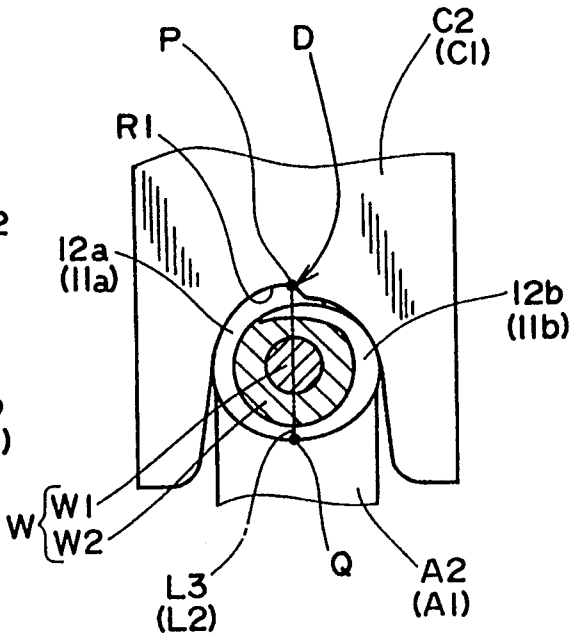

As shown in FIG. 12B, when the barrels 11, 12 are further pushed, the other barrel claws 11*b*, 12*b* can be securely guided on the inner peripheral sides of the barrel claws 11*a*, 12*a*, in that the chamfered surfaces 11*c*, 12*c* are formed at the tips of the other barrel claws 11*b*, 12*b*. On the other hand, as shown in FIG. 12C, when the barrels 11, 12 are further pushed, the barrel claws 11*a*, 12*a* can readily get over the step portions D, in that the chamfered surfaces 11*c*, 12*c* are formed at the tips of the barrel claws 11*a*, 12*a*, that the step portions D are inclined at an angle of 45°, and that the differences in level H are set to 1.5 time of the thicknesses t of the tips of the barrel claws 11*a*, 12*a*. This securely prevents the barrels 11, 12 from being crimped to the electric wire W with the tips of the barrels 11, 12 abut on each other.

In this embodiment, as best shown in FIG. 12C, virtual lines in respective cross sections connecting the deepest points Q of the pressure receiving surfaces R3 for receiving the barrels 11, 12, to the deepest points P of the caulking surfaces E for caulking the barrels 11, 12, are parallel with the axes of linear symmetry L2 of the barrels 11, 12 in their cross sections. Accordingly, the crimped portions X of the barrels 11, 12 are caulked such that the portions thereof along the axes of linear symmetry L2 project most.

Figure 1:
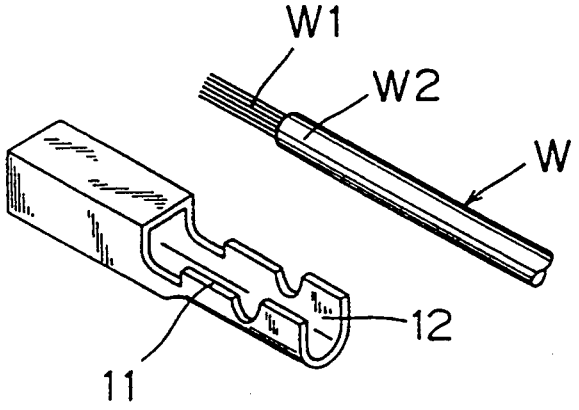
FIG. 1 PRIOR ART
FIG. 1 is a perspective view of a conventional crimped terminal.
Figure 2:
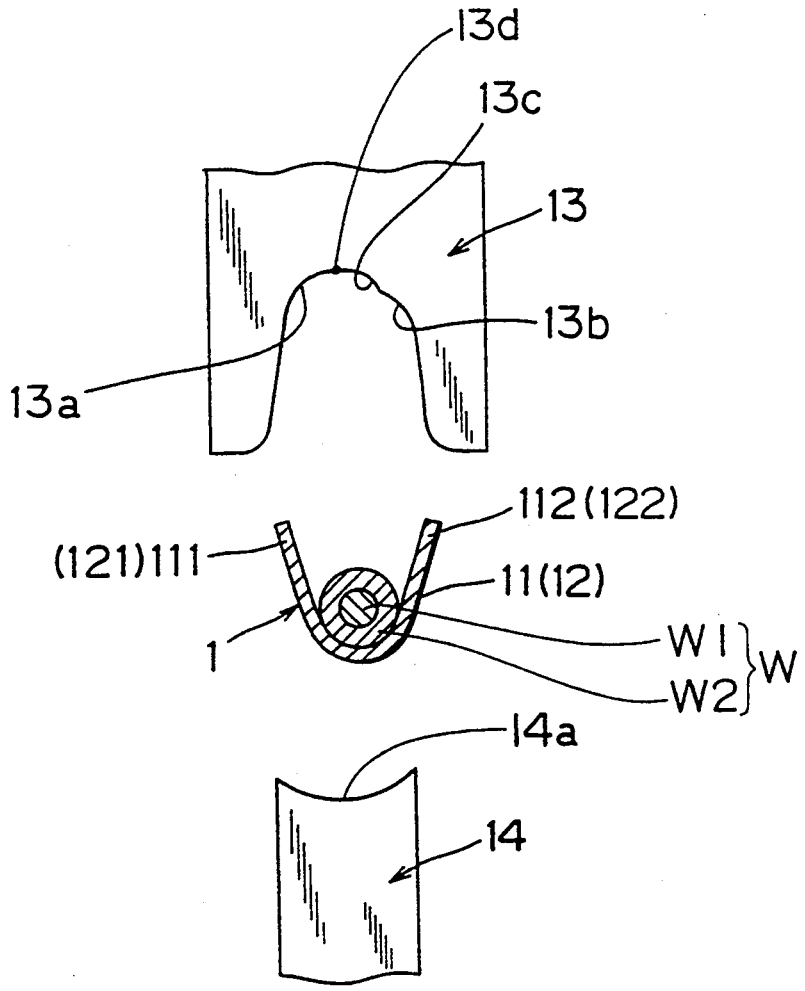
FIG. 2 PRIOR ART
FIG. 2 is a schematic enlarged view of main portions of a conventional terminal crimping apparatus.
Figure 3:
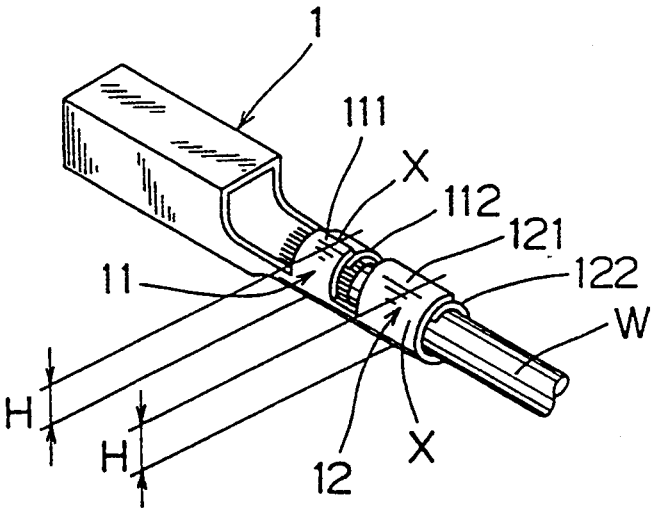
FIG. 3 PRIOR ART
FIG. 3 is a perspective view of a terminal which has been crimped to an electric wire by the conventional terminal crimping apparatus.
Figure 4:
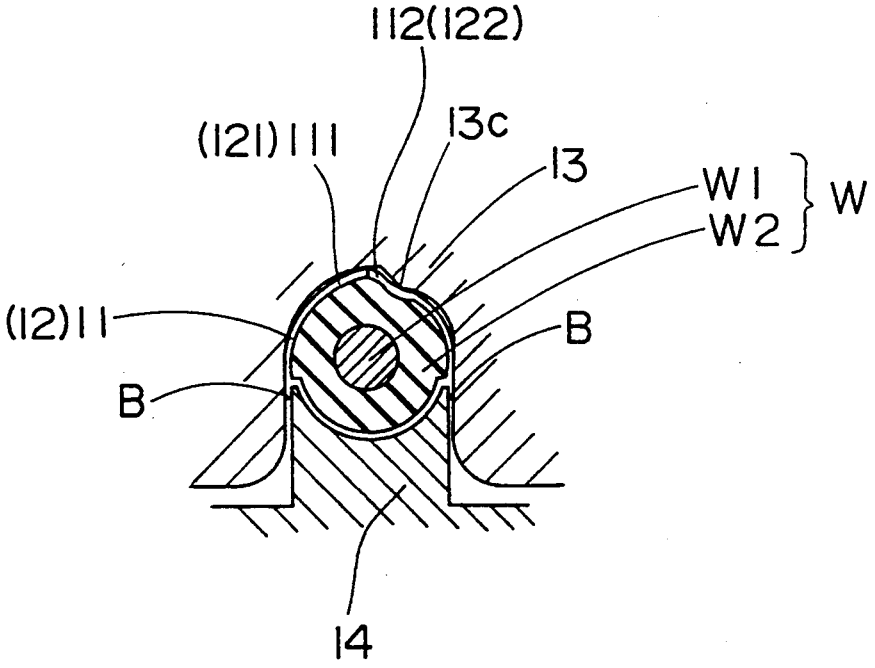
FIG. 4 PRIOR ART
FIG. 4 is a section view of a terminal portion crimped by the conventional terminal crimping apparatus.
Figure 5A:
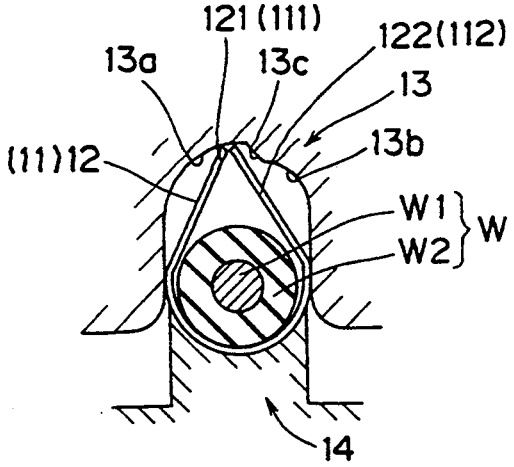
FIG. 5A PRIOR ART
FIG. 5A to FIG. 5D are schematic enlarged views of a terminal illustrating a conventional crimping mechanism with the passage of time.
Figure 5B:
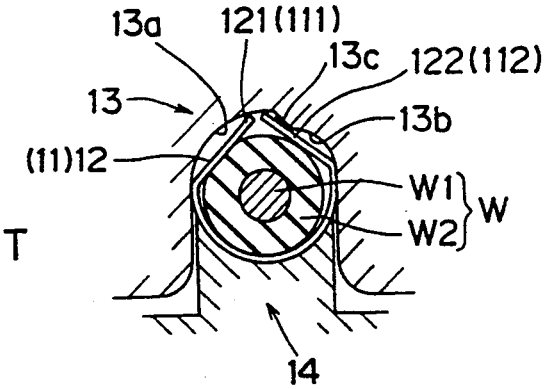
FIG. 5B PRIOR ART
Figure 5C:
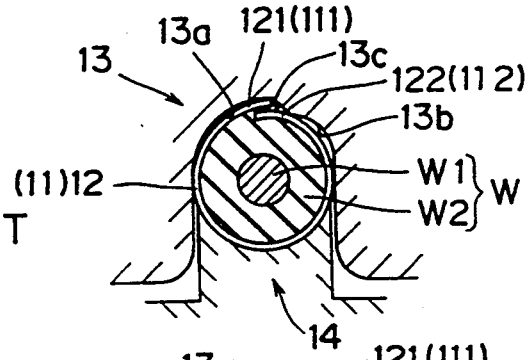
FIG. 5C PRIOR ART
Figure 5D:
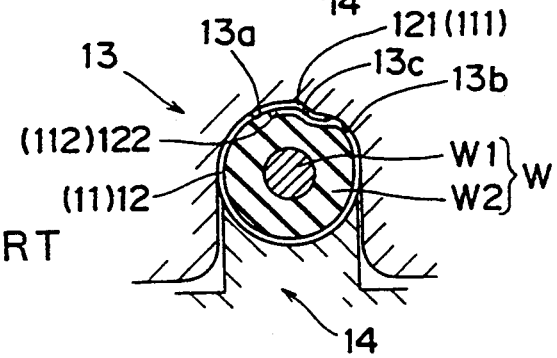
FIG. 5D PRIOR ART
Figure 6:
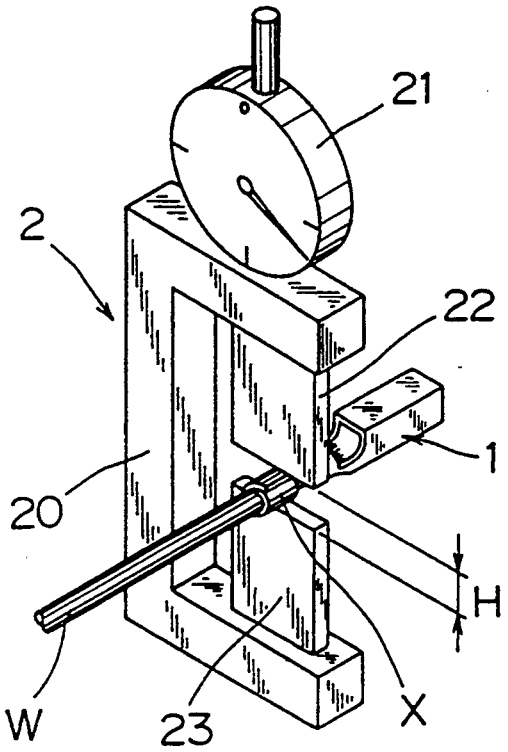
FIG. 6 PRIOR ART
FIG. 6 is a perspective view of a measuring device for measuring the crimp height of a crimped portion of a terminal.
Figure 7:
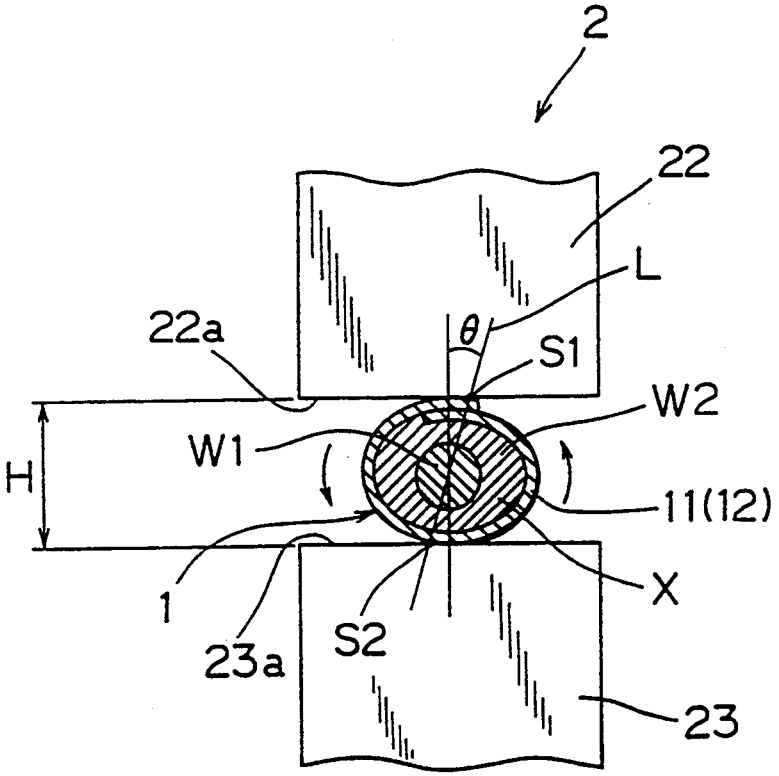
FIG. 7 PRIOR ART
FIG. 7 is a schematic enlarged view of main portions of the crimp height measuring device in FIG. 6.
Figure 13:
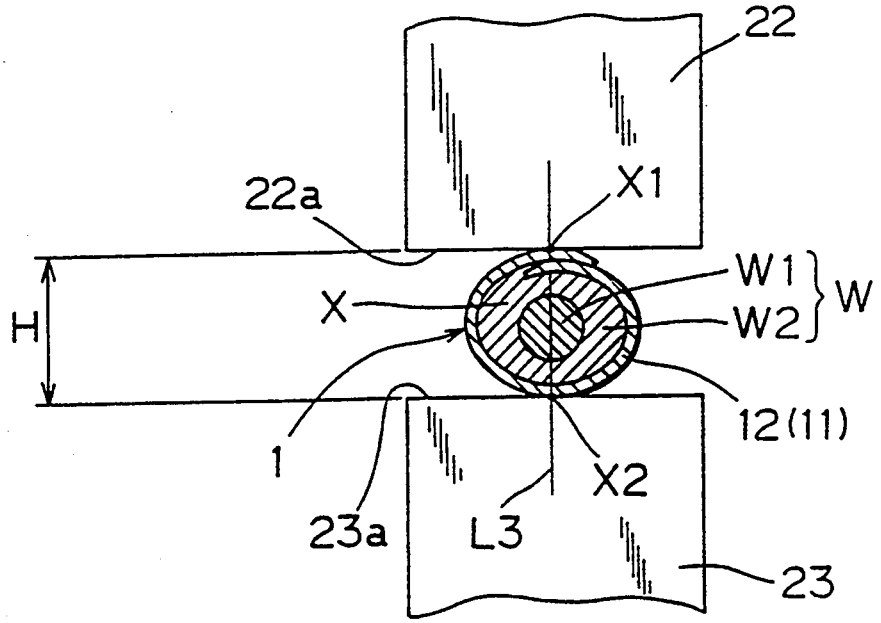
FIG. 13 is a schematic enlarged view illustrating how the crimp height of a crimped terminal is measured.

Accordingly, as shown in FIG. 13, even though the crimped portion X of each of the barrels 11, 12 is held by the measuring device 2 shown in FIG. 6 while maintaining each of the barrels 11, 12 in a caulked posture, no moment of rotation is applied to the crimped portion X of each of the barrels 11, 12. This prevents the crimped terminal from being unexpectedly rotated. Thus, the crimp height H can be accurately measured. It is therefore possible to accurately judge whether the crimping is good or defective.

In the embodiment above-mentioned, the present invention is shown as applied to both the crimper C1 for caulking the wire barrel 11 and the crimper C2 for caulking the insulation barrel 12. However, the present invention should not be limited to such an application, but may be applied to either one of the crimpers.

The present invention should not be limited to the embodiment above-mentioned, which is shown as a specific example only for clarifying the technical contents of the present invention. The present invention should not be construed in a narrow sense as limited to this specific example. Thus, the spirit and scope of the present invention are limited only by the description of the appended claims.

We claim:

1. A terminal crimping apparatus for crimping a terminal onto an electric wire, said terminal having a barrel with a pair of tips, said apparatus comprising:

pressure receiving means provided with a tip having a pressure receiving surface for receiving the terminal; and caulking means, having a caulking surface adapted to receive said tip of said pressure receiving means, for caulking the barrel of the terminal between said caulking surface and said pressure receiving surface of said pressure receiving means such that one of the tips of the barrel overlaps the other, wherein said caulking means has two rounding surfaces and a straight step portion having both ends respectively forming beginning points of said two rounding surfaces, one end of said straight step portion located at a deepest point formed at a middle portion of said caulking surface, a difference in level between said both ends of said step portion being such that said straight step portion prevents one of the tips of the barrel from displacing from one of said two rounding surfaces to the other of said two rounding surfaces in an early stage of crimping of the terminal.

2. A terminal crimping apparatus according to claim 1, wherein said straight step portion forms an inclined surface which is inclined from one round surface to the other round surface.

3. A terminal crimping apparatus according to claim 2, wherein said inclined surface is inclined at an angle of 45° with respect to a displacing direction of said caulking means.

4. A terminal crimping apparatus according to claim 1, wherein said difference in level between said both ends of said straight step portion is in a range from about 1 to about 1.5 times a thickness of the barrel.

5. A terminal crimping apparatus according to claim 4, wherein said apparatus is arranged to crimp a terminal wherein the tips of the barrel thereof are chamfered such that the thickness of the tips thereof is half of the entire thickness of the barrel.

6. A terminal crimping apparatus according to claim 1, wherein when the barrel is an insulation barrel to be crimped to a coated tip of the electric wire, said caulking means is a crimper for caulking the insulation barrel.

7. A terminal crimping apparatus according to claim 1, wherein when the barrel is a wire barrel to be crimped to a conductor of the electric wire, said caulking means is a crimper for caulking the wire barrel.

8. A terminal crimping apparatus according to claim 1, wherein said difference in level between said both ends of said straight step portion is not less than a thickness of the tips of the barrel.

9. A terminal crimping apparatus for crimping a terminal onto an electric wire, said terminal having a barrel of linear symmetry in cross section, said barrel having a pair of tips, said apparatus comprising:

pressure receiving means provided with a tip having a pressure receiving surface for receiving the terminal; and caulking means, having a caulking surface adapted to receive said tip of said pressure receiving means, for caulking the barrel of the terminal between said caulking surface and said pressure receiving surface of said pressure receiving means such that one of the tips of the barrel overlaps the other, wherein said caulking means has two rounding surfaces and a straight step portion having both ends respectively forming beginning points of said two rounding surfaces, one end located at a deepest point formed at a middle portion of said caulking surface, and wherein a deepest point of said pressure receiving surface and said deepest point of said caulking surface are located on a virtual line parallel with a line of symmetry of the barrel.

10. A terminal crimping apparatus according to claim 9, wherein the virtual line extends along a direction in which said caulking means are stroked.

11. A terminal crimping apparatus according to claim 9, wherein when the barrel is an insulation barrel to be crimped to a coated tip of the electric wire, said caulking means is a crimper for caulking the insulation barrel.

12. A terminal crimping apparatus according to claim 9, wherein when the barrel is a wire barrel to be crimped to a conductor of the electric wire, said caulking means is a crimper for caulking the wire barrel.

13. A terminal crimping apparatus according to claim 9, wherein when the barrel has tips chamfered at an outer peripheral side thereof, said straight step portion has a difference in level between said both ends thereof at least equal to a thickness of the tips of the barrel.

* * * * *